US007077035B1

(12) United States Patent
Huang

(10) Patent No.: US 7,077,035 B1
(45) Date of Patent: Jul. 18, 2006

(54) RATCHET OPEN-END WRENCH

(76) Inventor: Ping Wen Huang, No. 24-1, Shui Tui Lane, Nan Tun District, Taichung City (TW)

( * ) Notice: Subject to any disclaimer, the term of this patent is extended or adjusted under 35 U.S.C. 154(b) by 0 days.

(21) Appl. No.: 11/115,175

(22) Filed: Apr. 27, 2005

(51) Int. Cl.
*B56B 13/12* (2006.01)

(52) U.S. Cl. ..... 81/179; 81/58.2

(58) Field of Classification Search ..... 81/58.2, 81/179

See application file for complete search history.

(56) References Cited

U.S. PATENT DOCUMENTS 4,255,990 A * 3/1981 Doan ..... 81/179
5,768,958 A * 6/1998 Gamble ..... 81/58.2
6,202,516 B1 * 3/2001 Kim ..... 81/179
6,945,143 B1 * 9/2005 Kim ..... 81/179
2004/0031359 A1 * 2/2004 Kady ..... 81/179

* cited by examiner

*Primary Examiner*—Lee D. Wilson
*Assistant Examiner*—Anthony Ojini
(74) *Attorney, Agent, or Firm*—Rosenberg, Klein & Lee

(57) ABSTRACT

A ratchet open-end wrench has a handle with a head portion at an end thereof. The head portion has two jaw, between which is a gap to receive a bolt therein. The jaw has a recess, wherein a space formed from the gap and the recess allows the bolt for free rotation. The jaw is provided with a stepped bore, in which a holding assembly is received, and a hole, in which a restriction assembly is received. The bolt is held by the jaw and a shaft of the holding assembly to be rotated. While the handle is turned with the reacting force of the bolt aligned with a radial direction, the bolt is rotated by the shaft and the jaw. While the handle is turned to a reverse direction, the reacting force of the bolt move the shaft inwards to keep the bolt still.

1 Claim, 4 Drawing Sheets

RATCHET OPEN-END WRENCH

BACKGROUND OF THE INVENTION

1. Field of the Invention

The present invention relates generally to a wrench, and more particularly to a ratchet open-end wrench.

2. Description of the Related Art

FIG. 5 shows a conventional open-end wrench 7 having two jaws, on each of which a face 731 is provided. A space 73 is left between the faces 731, in which a bolt 81 is received with two parallel sides 811 associated with the faces 731. The wrench 7 is turned to rotate the bolt 81.

In the circumstance of limited space not enough for a close-end wrench or a ratchet wrench, the open-end wrench 7 is engaged with the bolt 81 via a lateral direction. While the wrench 7 is turned for an angle, the wrench 7 has to be drawn out, turned back to the initial angle and reengaged with the bolt 81 for another turning. The above steps have to be repeated many times to loose or fasten the bolt 81, it not an easy job.

SUMMARY OF THE INVENTION

The primary objective of the present invention is to provide a ratchet open-end wrench comprises a handle with a head portion at an end thereof. The head portion has two jaw, between which is a gap to receive a bolt therein. The jaw has a recess, wherein a space formed from the gap and the recess allows the bolt for free rotation. The jaw is provided with a stepped bore, in which a holding assembly is received, and a hole, in which a restriction assembly is received. The bolt is held by the jaw and a shaft of the holding assembly to be rotated.

While the handle is turned with the reacting force of the bolt aligned with a radial direction, the bolt is rotated by the shaft and the jaw. While the handle is turned to a reverse direction, the reacting force of the bolt move the shaft inwards to keep the bolt still. As a result, the wrench of the present invention has a ratchet function.

DETAILED DESCRIPTION OF THE INVENTION

Figure 1:
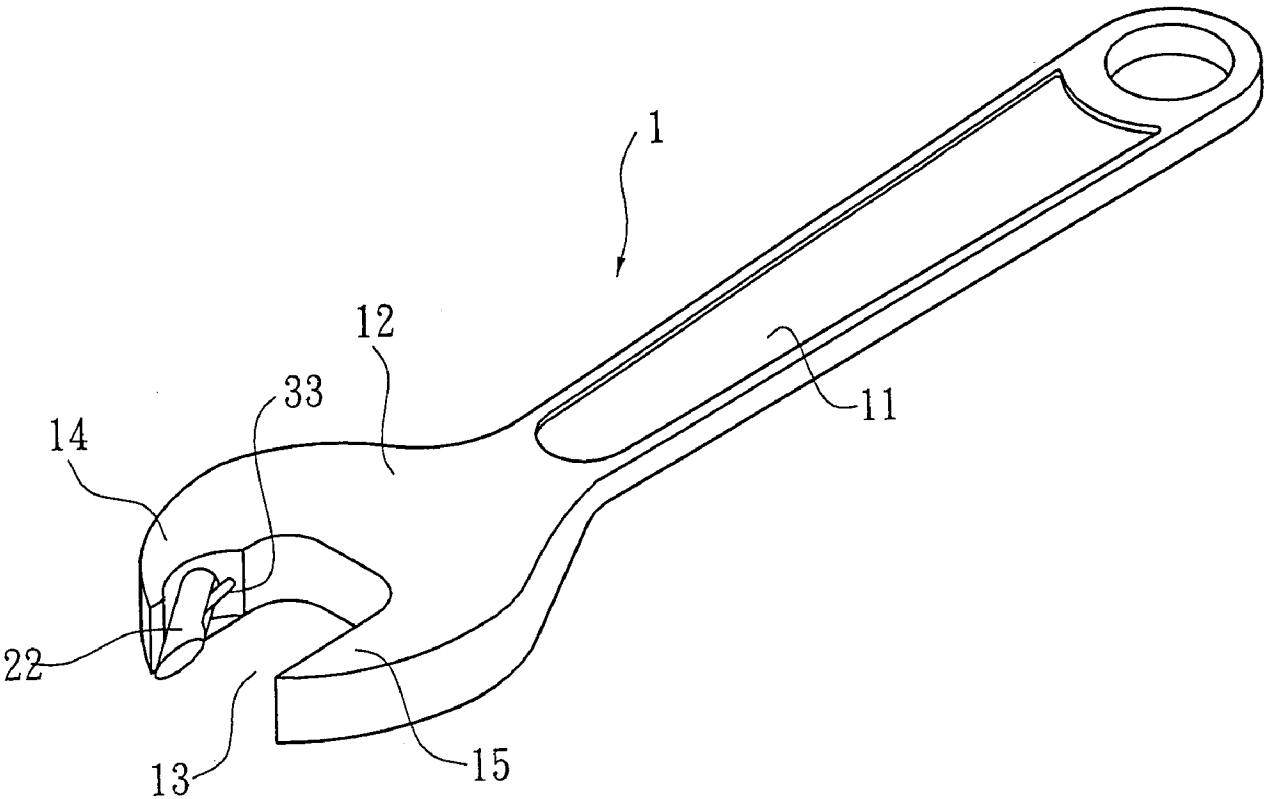
FIG. 1 is a perspective view of a preferred embodiment of the present invention.
Figure 2:
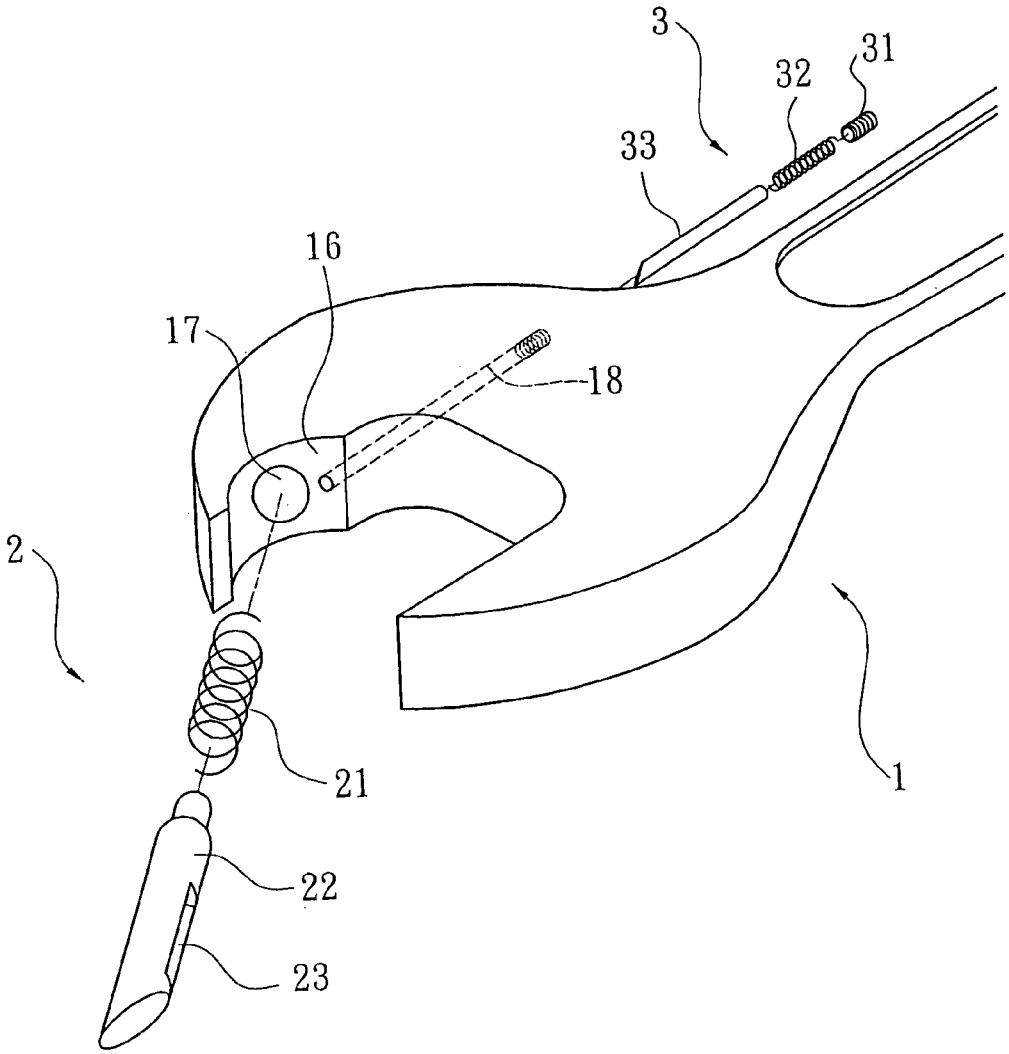
FIG. 2 is an exploded view of the preferred embodiment of the present invention.

As shown in FIG. 1 to FIG. 4, a ratchet open-end wrench of the preferred embodiment of the present invention comprises a handle 11 with a head portion 12 at an end thereof. The head portion 12 has a first jaw 14, a second jaw 15, and between which is a gap 13. A bolt 41 can be received in the gap 13 with two parallel sides associated with the first and second jaws 14 and 15. The first jaw 14 is provided with a recess 16. A space including the gap 13 and the recess 16 allows the bolt 41 received therein for free rotation. The first jaw 14 is provided with a stepped bore 17 with an exterior end on a wall of the recess 16. A holding assembly 2 is received in the stepped bore 17. The holding assembly 2 includes a spring 21 and a shaft 22. The shaft 22 is provided with a slot 23 at a circumference to be engaged with a restriction assembly 3, such that the shaft 22 is restricted by the restriction assembly 3 for reciprocation in a predetermined distance. The restriction assembly 3 is received in a hole 18 at the first jaw 14 having a set screw 31 an elastic member 32 and a pole 33. An exterior end of the hole 18 is adjacent to the exterior end of the stepped bore 17.

Figure 3:
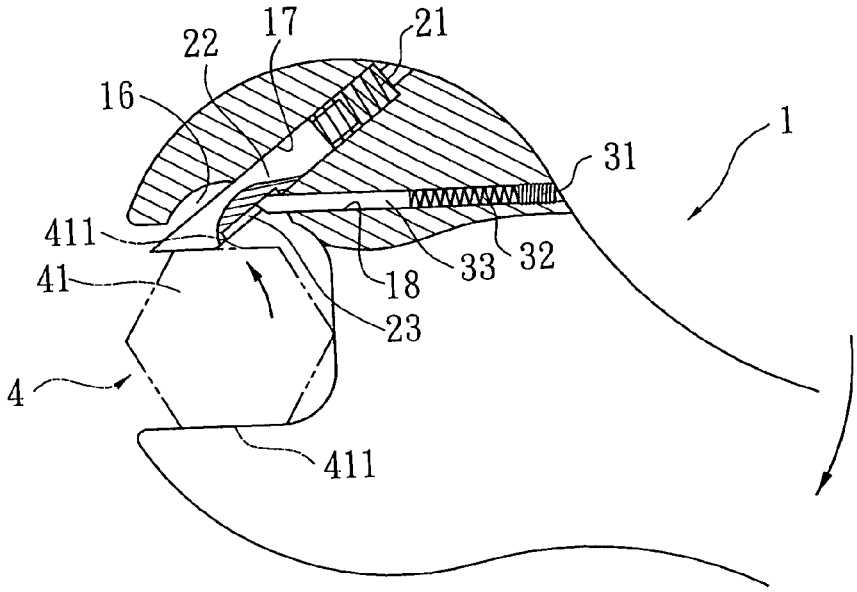
FIG. 3 and FIG. 4 are sectional view of the preferred embodiment of the present invention, showing the wrench in ratchet action.
Figure 4:
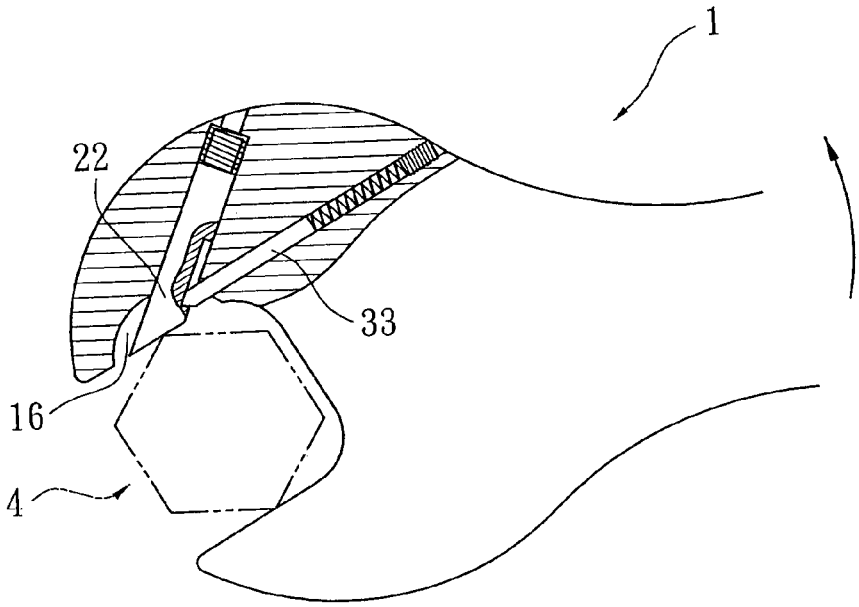
Figure 5:
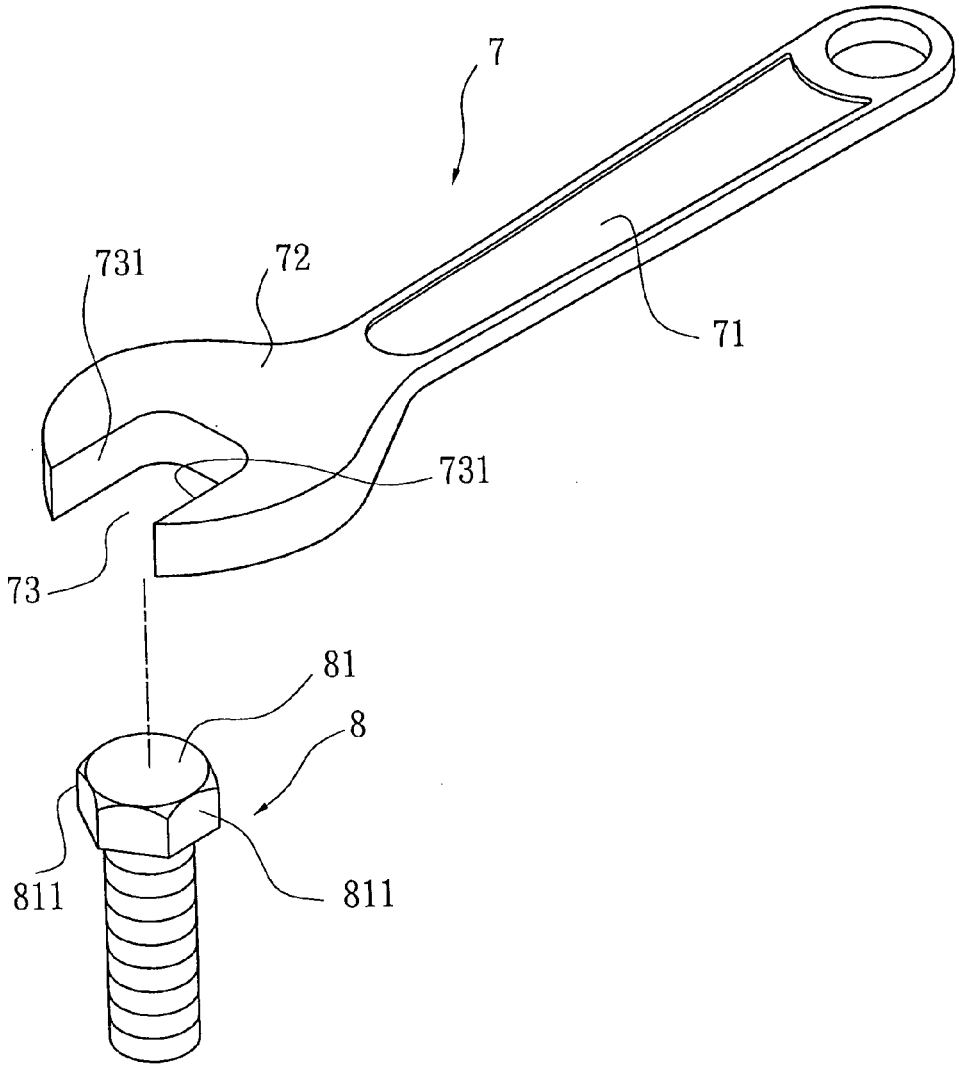
FIG. 5 PRIOR ART
FIG. 5 is a perspective view of a conventional open-end wrench.

As shown in FIG. 3, the bolt 41 is received in the gap 13, and the spring 21 urges the shaft 22 against the bolt 41. In other words, the bolt 41 is held by the shaft 22 and the second jaw 15. While the handle 11 is turned clockwise, as shown in FIG. 3, the reacting force of the bolt 41 is aligned with a radial direction to drive the shaft 22 against a wall of the stepped bore 17 to make the shaft 22 kept still. As a result, the bolt 41 is rotated by the actions of the second jaw 15 and the shaft 22. While the handle 11 is turned counter-clockwise, as shown in FIG. 4, the reacting force of the bolt 41 is aligned with an axial direction to move the shaft 22 inwards. As a result, the handle 11 is turned with the bolt 41 kept still. The wrench of the present invention has the ratchet function.

In conclusion, the present invention provides the recess on the jaw 14, the holding assembly 2 and the restriction assembly 2 to make the open-end wrench 1 have the ratchet function.

What is claimed is:

1. A ratchet open-end wrench, comprising a handle with a head portion at an end thereof; the head portion having a first jaw and a second jaw, between which is a gap to receive a bolt therein; the first jaw having a recess, wherein a space formed from the gap and the recess allowing the bolt for free rotation; the first jaw being provided with a stepped bore, in which a holding assembly is received, and a hole, in which a restriction assembly is received, said restriction assembly having a set screw, an elastic member and a pole therein, wherein the holding assembly has an elastic member and a shaft with a slot at a circumference thereof, and the restriction assembly is engaged with the slot of the shaft to restrict the shaft for reciprocation in a predetermined distance.

* * * * *